US005246312A

United States Patent [19]

Taki

[11] Patent Number: 5,246,312

[45] Date of Patent: Sep. 21, 1993

[54] SYSTEM AND METHOD FOR PRODUCING A COMPOSITE CUTOFF WALL

[76] Inventor: Osamu Taki, 2558 Somerset Dr., Belmont, Calif. 94002

[21] Appl. No.: 869,022

[22] Filed: Apr. 15, 1992

[51] Int. Cl.[5] ..... E02D 29/00

[52] U.S. Cl. ..... 405/267; 405/129; 405/176

[58] Field of Search ..... 405/176, 267, 38, 128, 405/129

[56] References Cited

U.S. PATENT DOCUMENTS

| | | | |
|---|---|---|---|
| 4,720,212 | 1/1988 | Steenbergen et al. | 405/176 |
| 4,877,358 | 10/1989 | Di Cervia | 405/267 |
| 4,929,126 | 5/1990 | Steenbergen et al. | 405/267 |
| 5,118,230 | 6/1992 | Justice | 405/128 |

FOREIGN PATENT DOCUMENTS

| | | | |
|---|---|---|---|
| 3012980 | 10/1981 | Fed. Rep. of Germany | 405/176 |
| 62-2084 | 1/1987 | Japan . | |

OTHER PUBLICATIONS

Kazuo Yamada, et al. "Development of a system and method for producing a continuous cut-off wall (TCW), Summary & Characteristics of the System and Method, and applicable examples for great depth operation", Oct. 1988, pp. 208-209, Construction Institute Annual Scientific Lecture, Lecture Epitome 6th.

*Primary Examiner*—David H. Corbin
*Attorney, Agent, or Firm*—Greg T. Sueoka

[57] ABSTRACT

A slurry wall lining system comprises a liner and a liner dispenser having a guide, an anchor, a support line, weights and fasteners. The liner dispenser preferably holds a liner in a rolled up position above the trench on rollers for insertion into the trench. The guide is preferably attached to the dispenser and can be angled to extend down into the trench. The liner is unrolled initially in a vertical direction down into the trench at a rate about equal to the movement of the dispenser along the trench. The liner then passes around the guide into a horizontal orientation in the trench. In the preferred embodiment, the weights pull the liner downward about the guide and secure one edge of the liner near the bottom of the trench. The fasteners, support line and anchor to hold the other edge of the liner along the top of the trench. The preferred method of the present invention comprises the steps of: excavating a trench; filling the trench with slurry and maintaining the slurry at predetermined level as the trench is excavated; inserting a lining into the trench by attaching one end of the lining at the beginning of the trench and unrolling the lining into the trench as the roll is moved along the trench; and backfilling the trench with selected materials on one or both sides of the liner.

24 Claims, 18 Drawing Sheets

BEST AVAILABLE COPY

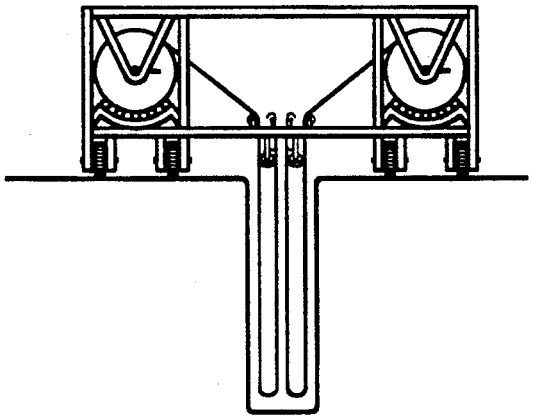
FIG. 9c1
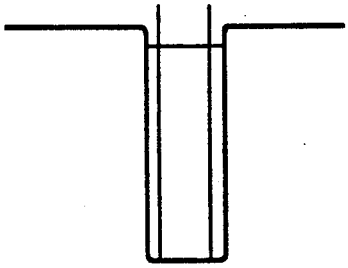
FIG. 9c2
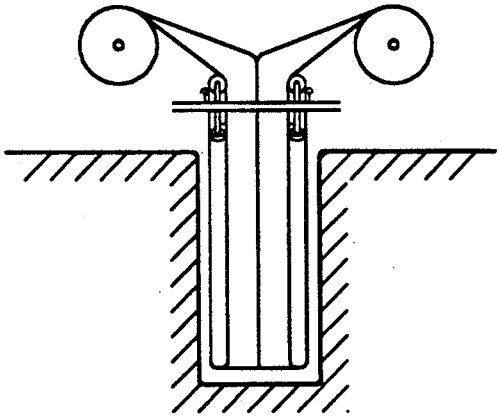
FIG. 9d1
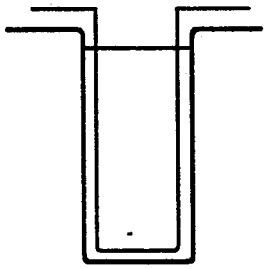
FIG. 9d2

SYSTEM AND METHOD FOR PRODUCING A COMPOSITE CUTOFF WALL

BACKGROUND OF THE INVENTION

1. Field of the Invention

The present invention relates to systems and methods for constructing cutoff walls. In particular, the Present invention relates to a system and method for producing a cutoff wall with improved impermeability by inserting a lining into a slurry wall.

2. Description of Related Art

Cutoff walls are typically used to impede the lateral flow of groundwater. Controlling the flow of ground water is essential to preventing contamination of the water supply. Cutoff walls are often used to isolate contaminated landfills and to prevent the ground water from being contaminated through contact with buried waste. Cutoff walls have also been used to seal dams, canal systems, and dikes for flood control purposes because of their low permeability. Other applications for cutoff walls include: dewatering and protecting deep excavation projects, hydraulically isolating lagoons and holding ponds, and enclosing oil and chemical tank farms.

As illustrated in FIG. 1, slurry cutoff walls are generally constructed by excavating a narrow trench (2–4 feet wide) with a backhoe or similar device. During the excavation process, the trench is filled with slurry and maintained at a level near the top of the trench. The use of slurry, conventionally of bentonite and water, allows excavation without the need for other lateral support. The narrow trench is then backfilled with excavated soil and selected impervious materials to create a cutoff wall. The selected materials are typically commercially available clays and cement. One advantage of the slurry wall technique is that it is relatively inexpensive to construct a cutoff wall.

However, one problem with the cutoff walls of the prior art is their permeability. Slurry cutoff walls generally have a permeability that reaches at best $1\times10^{-6}$ to $5\times10^{-7}$ cm/sec. This becomes a problem when very low permeability is required such as when isolating hazardous wastes as shown in FIG. 2. When the waste site is near an aquifer or other ground water source the permeability must be at least $1\times10^{-8}$ cm/sec. Very low permeability cutoff walls are also needed for flood control purposes to prevent seepage through dikes, influence on the areas surrounding the cutoff wall and the collapse of dikes. Therefore, there continues to be a need for a system and method for efficiently producing cutoff walls with very low permeability.

SUMMARY OF THE INVENTION

The present invention overcomes the deficiencies of the prior art by providing a system and method for installing an impermeable liner in a slurry wall to improve the impermeability of the slurry cutoff wall. A preferred invention comprises a liner, a liner dispenser with a guide, an anchor, a support line, weights and fasteners. The liner dispenser Preferably holds a liner in a rolled up position above the trench. The liner dispenser holds the liner on rollers and provides alignment rollers so that the liner may be easily unrolled. The liner dispenser has wheels for movement along the trench. The guide is preferably attached to the dispenser and can be positioned to extend down into the ground at a 45 degree angle. The liner is unrolled initially in a vertical direction down toward the trench at a rate about equal to the movement of the dispenser along the trench. The liner then passes around the guide into a horizontal orientation in the trench. The weights are used to pull the liner downward about the guide and secure one edge of the liner near the bottom of the trench. The fasteners are used with the support line and the anchor to hold the other edge of the liner along the top of the trench. In the preferred embodiment, the anchor is mounted near the beginning of the trench and the support line is attached between the anchor and the liner dispenser to hold the support line above the trench. The fasteners are attached spaced apart along the upper edge of the liner between the liner and the support line.

The present invention also includes a method for installing the lining system within a cutoff wall. The Preferred embodiment of the method of the present invention comprises the steps of: excavating a trench; filling the trench with slurry and maintaining the slurry at predetermined level as the trench is excavated; inserting a lining into the trench by attaching one end of the lining at the beginning of the trench and unrolling the lining into the trench as the roll is moved along the trench; and backfilling the trench with selected materials on one or both sides of the liner.

BRIEF DESCRIPTION OF THE DRAWINGS

FIGS. 9A–9D are alternate embodiments of the present invention for inserting double linings into the slurry wall;

DETAILED DESCRIPTION OF THE PREFERRED EMBODIMENTS

Figure 1:
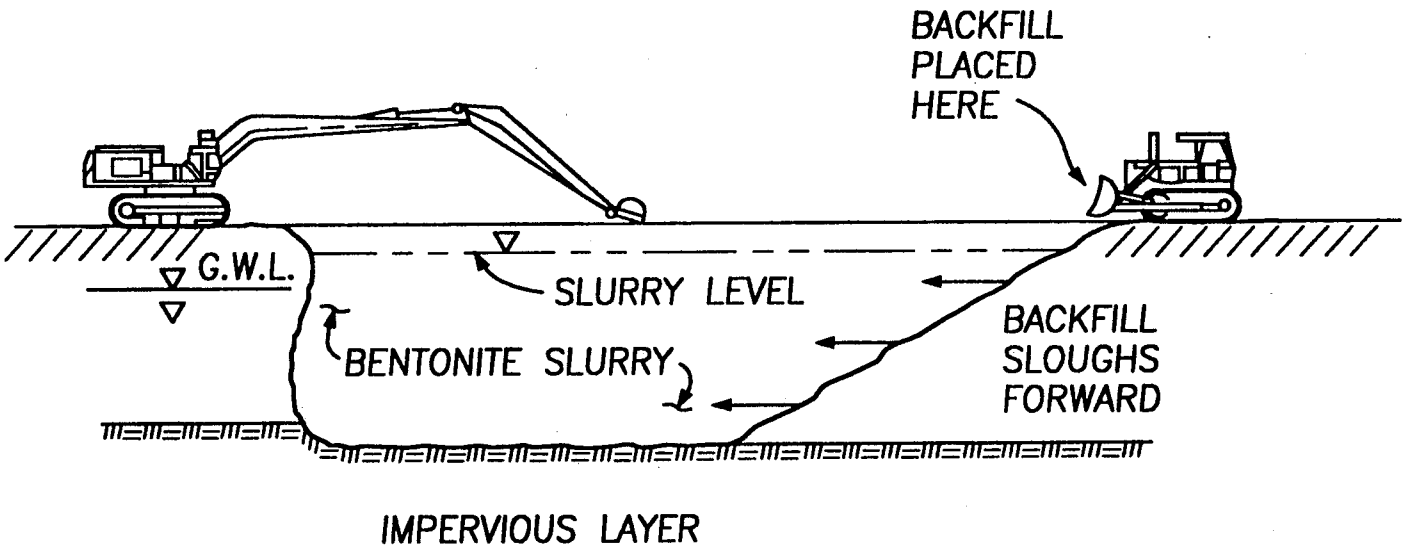
FIG. 1 (PRIOR ART)
FIG. 1 is a schematic diagram of the construction of a slurry cutoff wall as known in the art.
Figure 2:
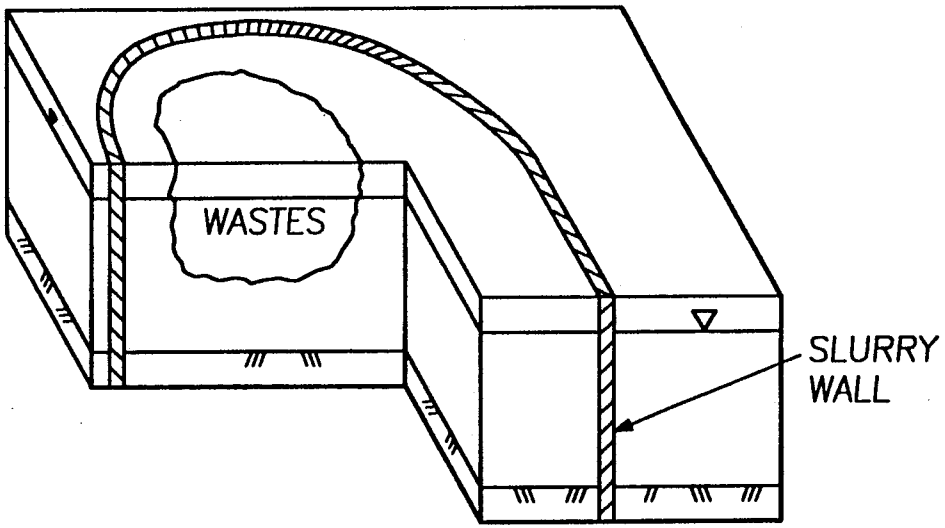
FIG. 2 (PRIOR ART)
FIG. 2 is a schematic diagram, partially in cross-section, showing a waste site isolated by a cutoff wall as known in the art.
Figure 3:
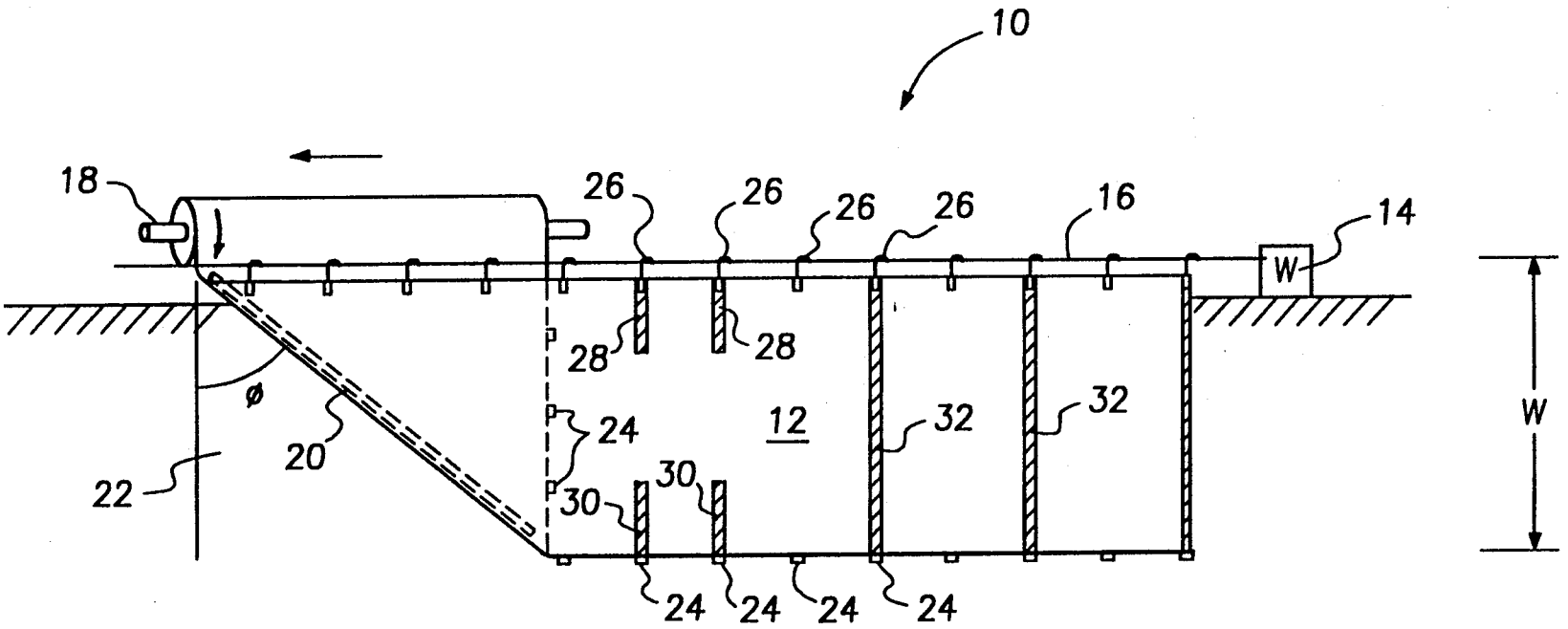
FIG. 3 is a simplified schematic diagram of the preferred embodiment of the lining system of the present invention.

Referring now to FIG. 3, a simplified schematic diagram of a lining system 10 constructed in accordance with the present invention is shown. FIG. 3 illustrates a side view of a trench 22 filled with slurry as the lining system 10 of the present invention it is being installed. The lining system 10 preferably comprises a liner 12, an anchor 14, a support line 16, a positioning rod 18 and a guide 20. The liner 12 further comprises weights 24 and fasteners 26. The weights 24 are attached spaced apart along one longitudinal edge (bottom edge) of the liner 12 and the fasteners 26 are attached spaced apart along the opposite edge (top edge) of the liner 12. As shown in FIG. 3, the liner 12 is preferably stored in rolled form before insertion into the trench 22. The liner 12 is preferably unrolled at rate that is about the same as the rate at which the roll of liner 12 is moved along the trench. The liner 12 is unrolled by forcing it downward in a vertical orientation with the aid of the weights 24 and gravity. As the rod 18 carries the rolled portion of the liner 12 along the trench 22, the liner 12 is unrolled and forced about the guide 20 to a horizontal orientation in the trench 22. The anchor 14 is preferably secured in the ground near the beginning of the trench 22. The support line 16 is attached to the anchor 14, and pulled tight parallel above the trench 22. The fasteners 26 are attached to the support line 16 to ensure that the liner 12 extends between the top and the bottom of the trench 22.

The liner 12 is preferably constructed from an impermeable material that is light weight, provides some elasticity, and is thin and strong. For example, the liner 12 may be constructed of polyethylene or other plastic through which water and other liquids are impermeable. In particular, the liner may be polyvinyl chloride (PVC), high density polyethylene or urethane. The liner 12 preferably has a width of 30 to 40 feet thereby allowing the trench 22 depth to be of comparable depths. The length of the liner 12 is advantageously variable and can be sized to match length of the trench 22 into which the liner 12 is being placed since liners of various lengths may be rolled and placed on the positioning rod 18. The use of the liner 12 in rolled form is particularly advantageous because the minimum number of liner sheets are used and there are no seams or seals that can affect permeability.

Figure 6:
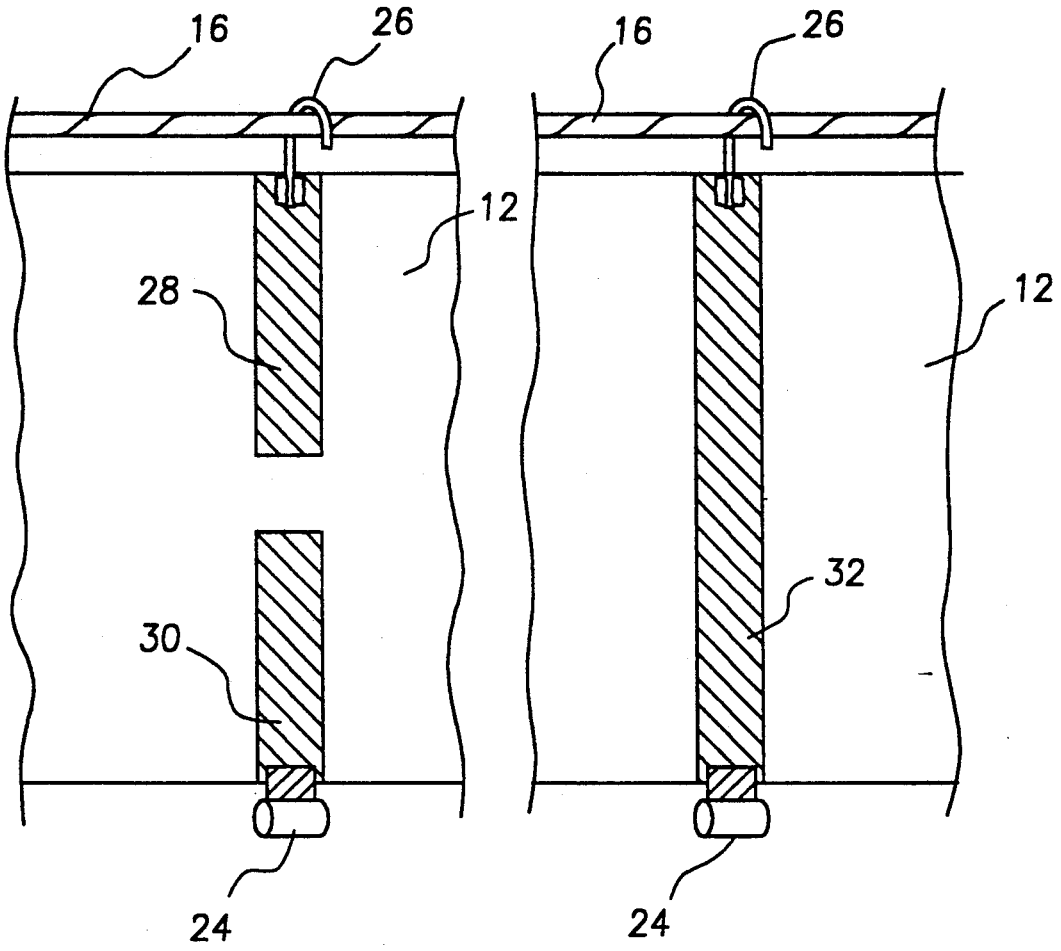
FIG. 6 is a sectional side view of the liner of the present invention showing preferred embodiments for the clips and weights.

As shown in FIG. 3, and more particularly in FIG. 6, weights 24 and fasteners 26 are attached to the liner 12. The weights 24 are used to force the bottom edge of the liner 12 downward and around the guide 20. Each weight 24 is preferably made of dense metals heavier that the liner 12. The metals are preferably non-hazardous and do not react with the slurry or the materials being isolated by the cutoff wall. Each weight 24 is preferably heavier than the section of the liner 12 to which it is attached. The weights 24 are preferably attached to the liner 12 using tape, adhesive, clips or similar fasteners. For example, clips that apply more attaching force depending on the weight applied are preferred. In comparison, the fasteners 26 are used to secure the other edge of the liner 12 to the support line 16 and hold the top edge of the liner 12 near the top of the trench 22. The fasteners 26 may be rings, clip or similar devices used for attachment to a rope or wire. The fasteners 26 are preferably attached to the liner 12 with tape, adhesive, clips or other fasteners. As will be described in more detail below, the weights 24 and fasteners 26 may either be pre-mounted to the liner 12, and thus, already existing as the liner 12 is unrolled, or the weights 24 and the fasteners 26 may manually be attached to the respective edges of the liner 12 as it is unrolled and before it passes about the guide 20 at the time of insertion. Both the weights 24 and fasteners 26 are preferably supported by reinforcement strips 28, 30 and 32. A single reinforcement strip 32 that extends from opposite edges across the width of the liner 12 is used to distribute the force applied by the weights 24 and the fasteners 26. Alternatively, a pair of strips 28, 30 may be used in place of the single strips 32. When a pair of strips 28, 30 are used, one strip 28 distributes the force applied to the top edge of the liner 12 by the fasteners 26, and the second strip 30 distributes the downward force applied across the liner 12 by the weights 24. Each strip 28, 30 extends from a respective edge of the liner 12 toward the middle of the liner 12.

FIG. 6 also illustrates a preferred embodiment of the support line 16. The support line 16 is preferably a cable, however, wires and ropes may also be used. The support line 16 is also resistant to water and other liquids that may be contained in the slurry. In the preferred embodiment, the support line 16 can support more than twice the weight of the liner 12 in downward force. The support line 16 is preferably mounted between the anchor 14 and the dispenser 40 above the trench 22. It should be understood by those skilled in the art that the support line 16 may also be mounted between a first anchor and a second anchor above the trench 22, thereby eliminating any connection of the support line 16 to the dispenser 40.

Figure 8A:
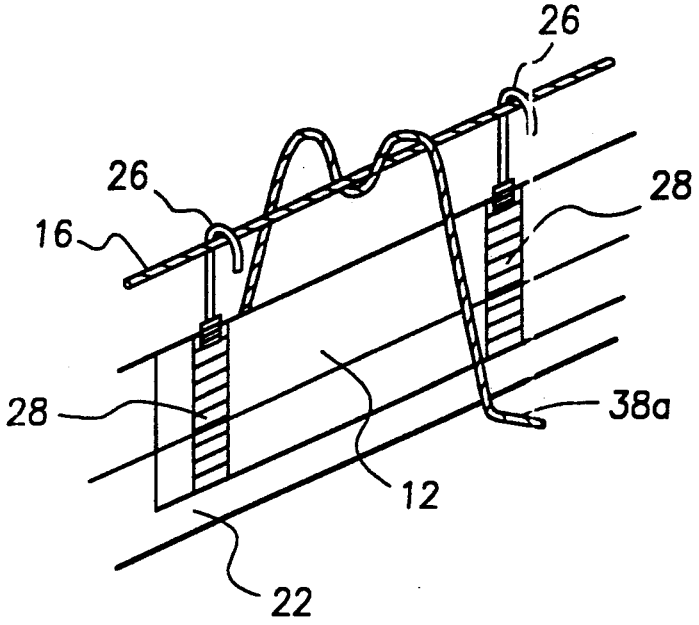
FIGS. 8A and 8B are perspective views of a support means for holding the support line at a preferred height from the ground.
Figure 8B:
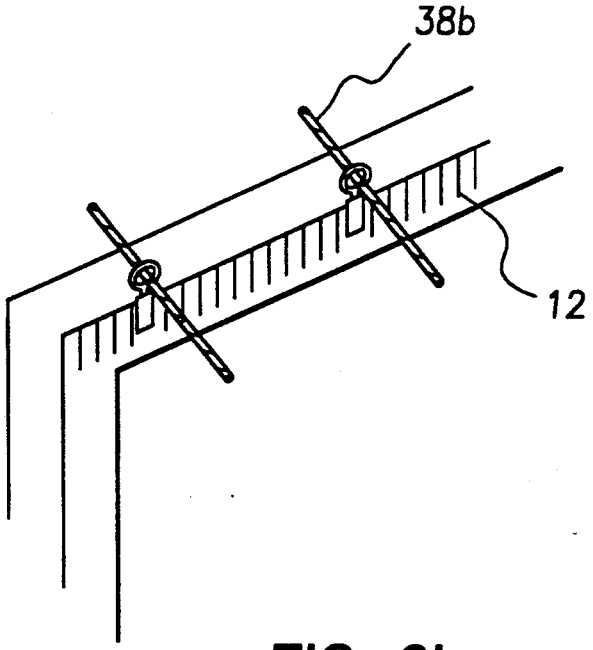

As shown in FIGS. 8A and 8B, additional support may be applied to the support line 16 using a support member 38*a* and 38*b*. The support member 38*a* is preferably formed of from a steel rod or bar, and generally has an inverted "W" shape. This shape is advantageous since the notch formed between the legs of the support member 38 are ideal for receiving the support line 16. In a simpler design, the support member 38*b* may be a rod that extends across the trench 22 as shown in FIG. 8B. In the preferred embodiment, a plurality of support members 38*a* and 38*b* are positioned spaced apart along the trench 22 to hold the support line 16 at a predetermined height above the trench 22.

Figure 4A:
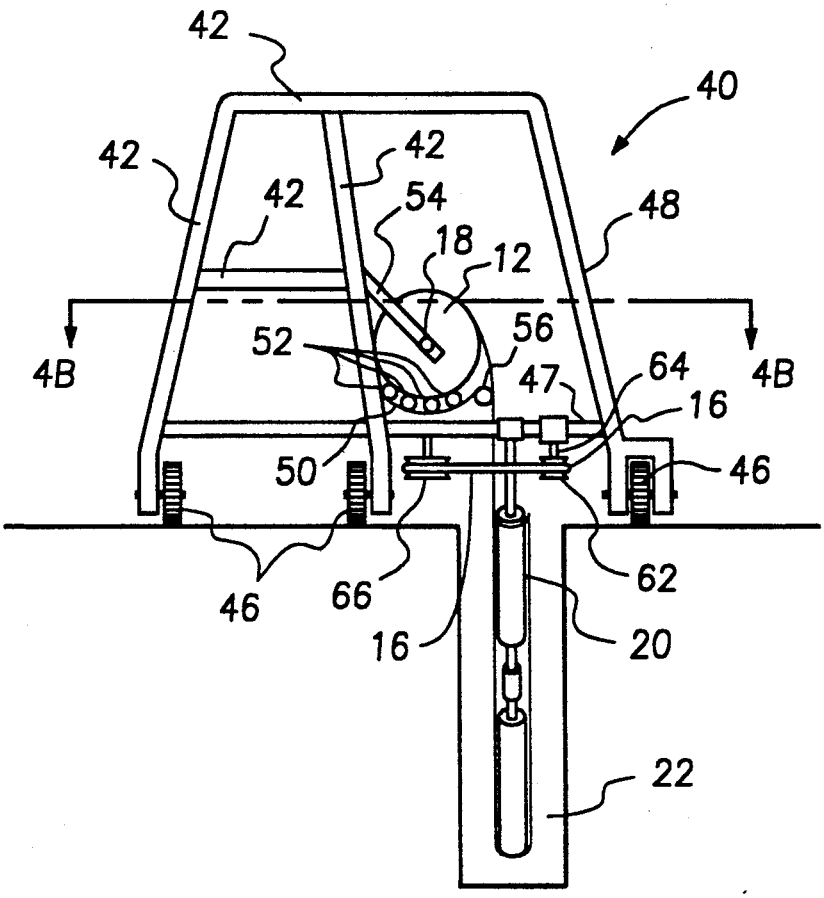
FIG. 4A is a front side view of a preferred embodiment of a lining dispenser of the present invention.
Figure 7A:
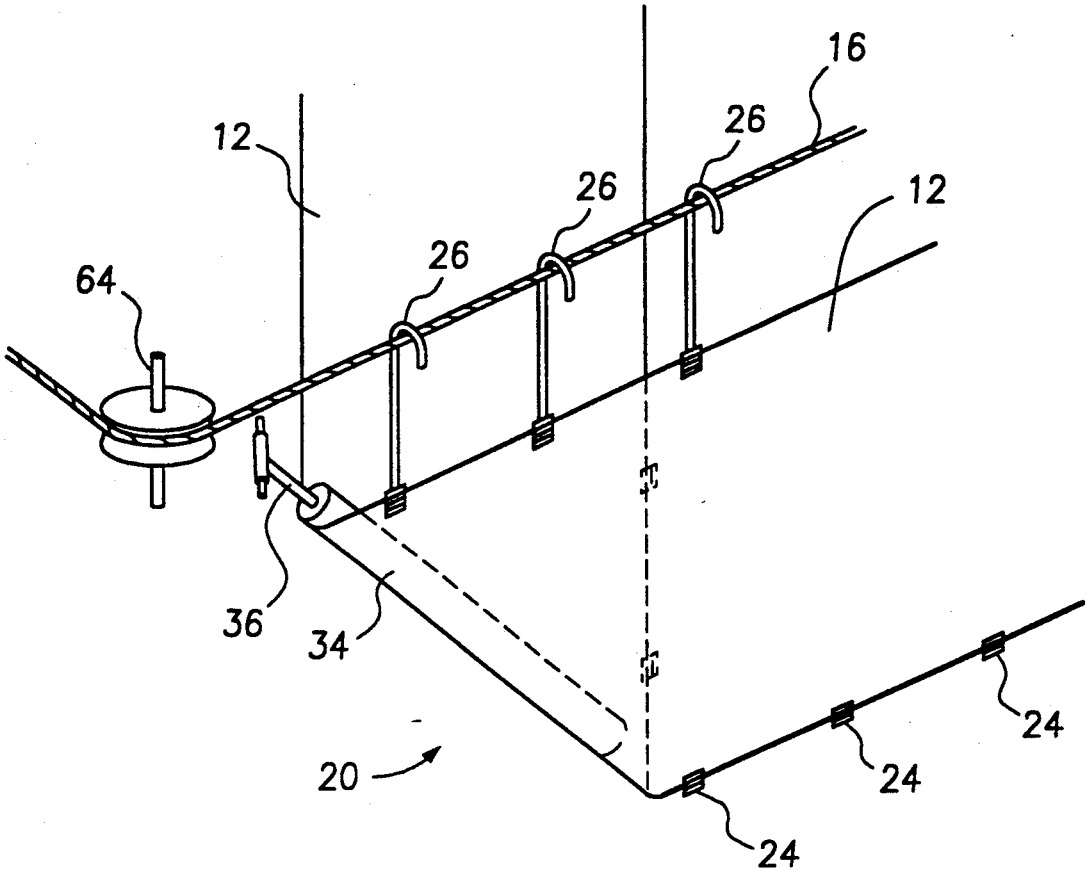
FIGS. 7A–7E are perspective views of the Preferred and alternate embodiments of the guide of present invention as used with the liner.
Figure 7B:
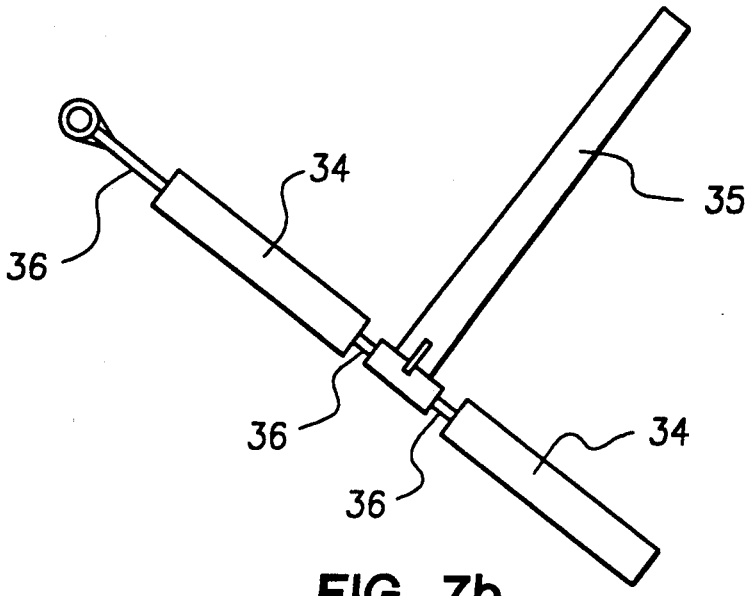
Figure 7C:
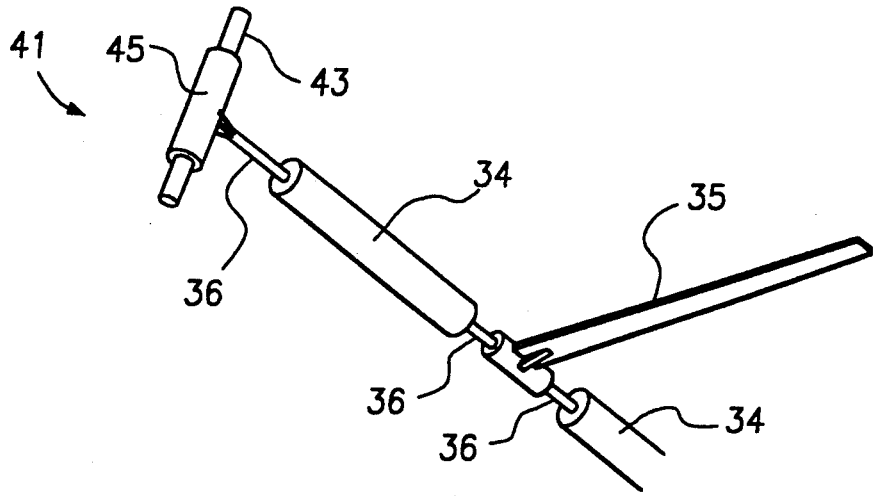

Referring now to FIGS. 7B and 7C, a preferred embodiment of the guide 20 is shown. The guide 20 is preferably a cylindrical roller 34 mounted to rotate about a shaft 36. During use, the shaft 36 is preferably angled downward into the trench 22 as shown in FIGS. 3 and 4A. For example, the shaft 36 may be positioned at an angle 45 degrees from the top edge of the liner 12. The rollers 34 rotate freely about the shaft 36 to assist the liner 12 as it transitions from the vertical orientation to the horizontal orientation. As shown in FIG. 4C, the guide 20 is preferably adjustably mounted to a liner dispenser 40. The guide 20 is retractable from the angled position into the trench 22 used for normal operation to a storage position. The attachment of the guide 20 to the liner dispenser 40 allows movement between these positions. For example, the guide 20 may be rotatably mounted to swing from a position parallel to the positioning rod 18 to a position 45 degrees from the positioning rod 18. As shown in FIGS. 7B and 7C, a lever 35 is attached to the shaft 36 at a position between the rollers 34. The lever 35 allows the guide 20 to be moved between the operational position shown in FIG. 4A and a storage position where the guide 20 is parallel with the longitudinal axis of the roll of liner 12.

Figure 7D:
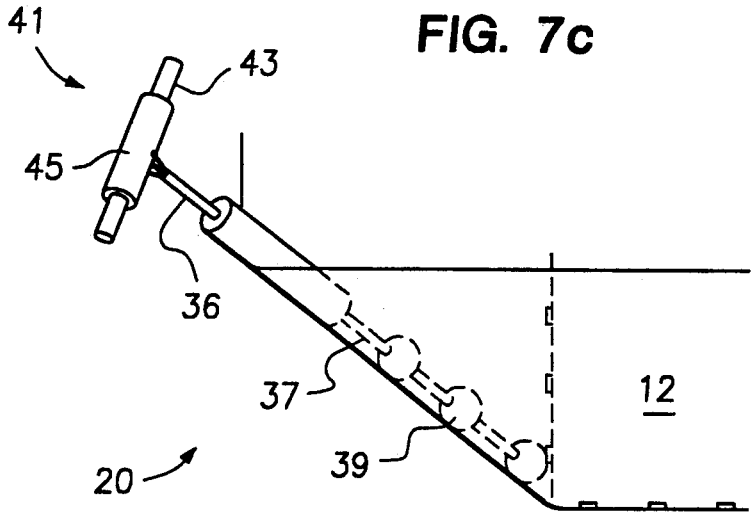
Figure 7E:
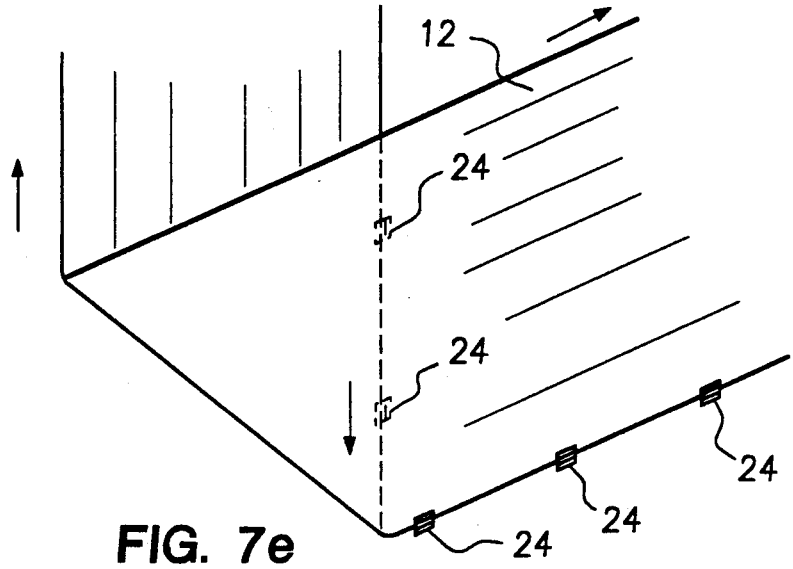

Referring now to FIGS. 7A, 7D and 7E, several alternate embodiments for the guide 20 are shown. While the guide 20 is preferably a pair of rollers 34 as described above, it should be understood to those skilled in the art that the guide 20 may also be a rod about which the liner 12 slides as it is inserted into the trench 22 as shown in FIG. 7A. In other alternate embodiments, the guide 20 may be shortened and even eliminated in some applications. One alternate embodiment shown in FIG. 7D provides a guide 20 with a significantly reduced length. For example, the shortened guide 20 may be a length about ¼ of the width of the liner 12. This is advantageous because it provides a guide 20 that is much easier to move and follow paths that are not linear. The guide 20 may be further modified to include a rod 37 with a plurality of spheres 39 spaced apart along the rod as shown in FIG. 7D. In yet another embodiment shown in FIGS. 7C and 7D, the guide 20 includes an adjustable mounting assembly 41 positioned at one end of shaft 36. The adjustable mounting assembly 41 includes a rod 43 and roll bar 45 mounted perpendicular to shaft 36 for adjustment of the shaft 36 between a first position parallel to the plane formed by the ground and a second position in the trench at an angle acute to the plane formed by the ground. In yet another embodiment shown in FIG. 7E, the present invention may be operated without a guide 20. In such an embodiment, the liner 12 is manually positioned as shown in FIG. 3 to establish the 45 degree angle where the liner 12 transitions from the vertical orientation to the horizontal orientation. Once the transition has been established, it will be maintained by the weights 24 and the tension along the top edge of the liner 12.

Figure 4B:
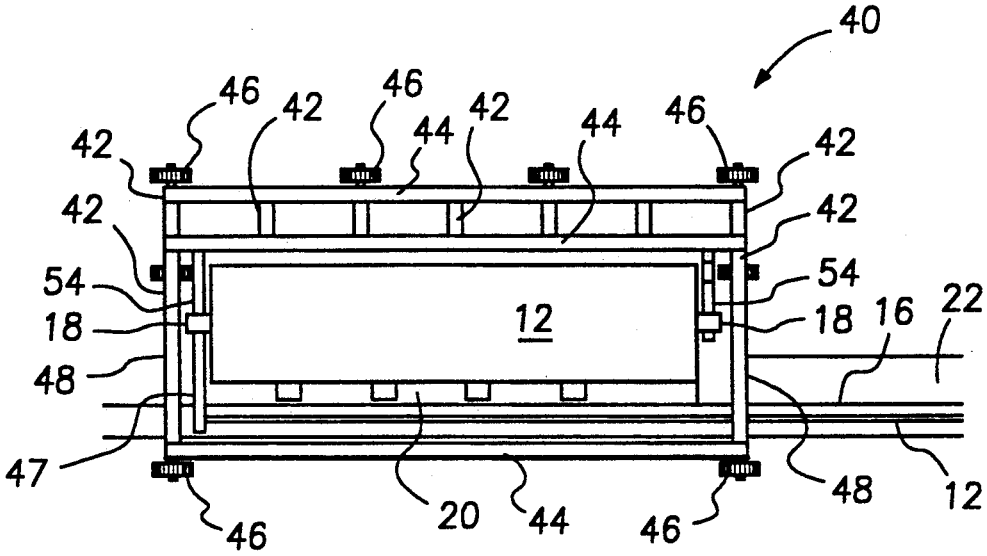
FIG. 4B is a cross-sectional view of the Preferred embodiment of the lining dispenser of the present invention taken along line 4B—4B of FIG. 4A.
Figure 4C:
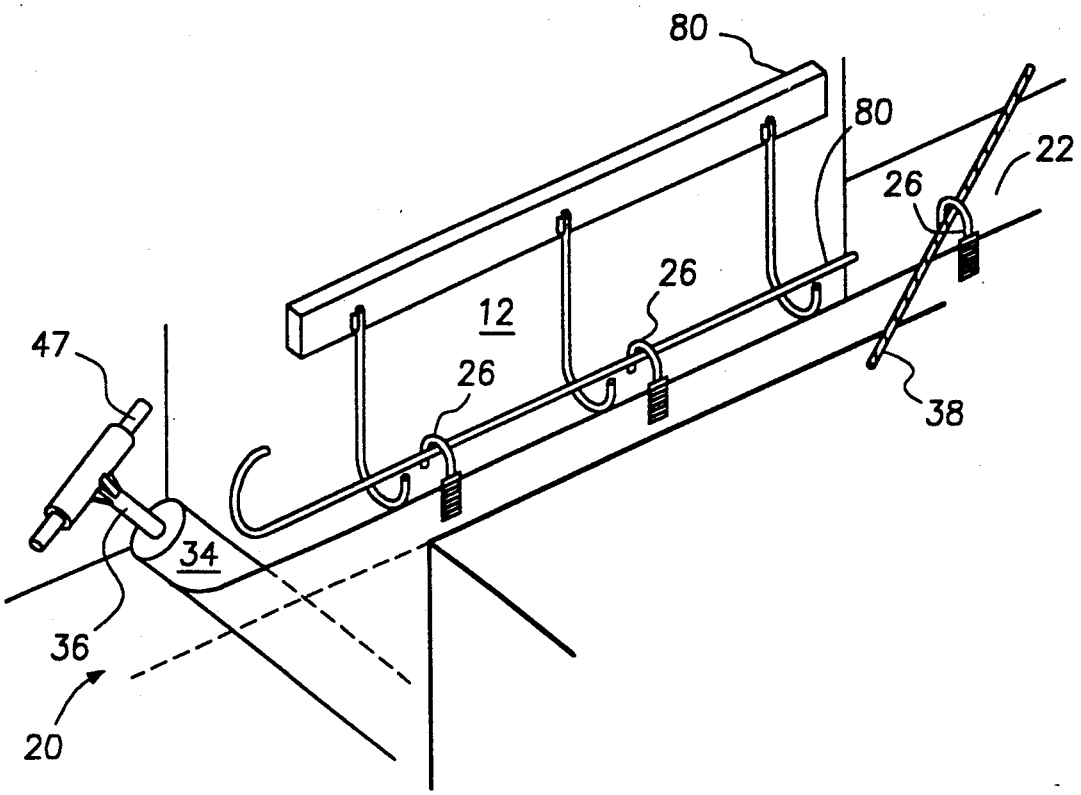
FIG. 4C is a perspective view of the support and guide portions of the dispenser.

Referring now to FIGS. 4A–4C, a preferred embodiment of the liner dispenser 40 is shown. The liner dispenser 40 is used to place the liner 12 in the trench 22 and transport the rolled up portion of the liner 12. The liner dispenser 40 preferably comprises a plurality of frame members 42, a plurality of longitudinal supports 44, a plurality of lateral supports 47, and a pair of extension arms 48. The frame members 42 generally have an "A" shape. Wheels 46 are attached to the legs of the frame members 42, thus, making the dispenser 40 easy to move along the trench 22. For added stability, the extension arms 48 are attached to the central portion of the outermost frame members 42 to form a "L" shape that extends over the trench 22. On the end of each extension arm 48 distal the frame members 42, a wheel 46 is attached. Near the wheel, the lateral support 47 connects the extension arm 48 to the outermost frame members 42. As shown best in FIG. 4B, the plurality of longitudinal supports 44 connect the frame members 42 and extension arms 48 together to form the dispenser 40.

A seat 50 is also attached to the each frame members 42 on the same side as the extension arms 48. The seat 50 provides an area upon which the roll of liner 12 rests. As shown best by FIG. 4A, each seat 50 has a plurality of rollers 52 attached parallel to the longitudinal axis of the roll of liner 12. The rollers 52 allow the liner 12 to be rotated about its longitudinal axis for unrolling the liner 12 into the trench 22. The roll of liner 12 is held in place by a pair of arms 54. The arms 54 are respectively attached to the outermost frame members 42. A ring (not shown) is attached on the end of each arm 54 distal the frame member 42. The ring is preferably sized to be received in the roll of liner 12. As shown in FIGS. 4A and 4B, a plurality of guide rollers 56 are used to force the liner 12 in a vertical orientation down into the trench 22. The guide rollers 56 are mounted on the edge of the seat 50. The liner 12 is advantageously threaded about the guide rollers 56 vertically downward to the guide 20. The liner 12 roll is preferably coupled to a motor to unroll the liner 12 during insertion into the trench. Similarly, the movement of the dispenser 40 along the trench can also be mechanized. In the preferred embodiment, the liner dispenser 40 unrolls liner 12 at the same rate at which the dispenser 40 is moved along the trench, thereby, maintaining a specified tension along the top edge of the liner 12.

Referring again to FIG. 4A, the present invention also includes a spool 66 and a wheel 62 to respectively hold and guide the unused portions of the support line 16. The wheel 62 is preferably mounted on the dispenser 40 adjacent to the guide 20. A rod 64 extends substantially vertical from the dispenser 40 hold the wheel 62 just above the top edge of the inserted portion of the liner 12. The wheel 62 is positioned so that additional portions of the support line 16 may be wound or unwound onto the spool 66 to maintain tension between the spool 66 and the anchor 14. The wheel 62 is positioned with one side parallel to the longitudinal axis of the trench 22. The spool 66 is also mounted on the dispenser 40 and either winds to removed slack in the support line 16 or unwinds as the dispenser 40 is moved farther from the anchor 14.

Figure 5A:
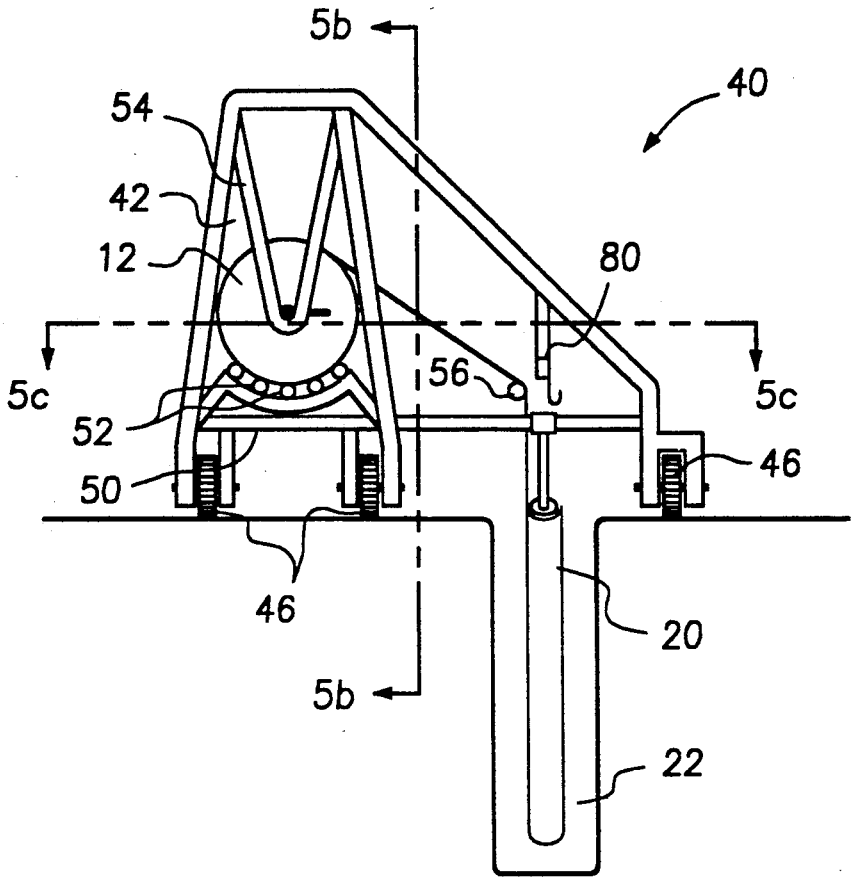
FIG. 5A is a front side view of an alternate embodiment of the lining dispenser of the present invention.
Figure 5B:
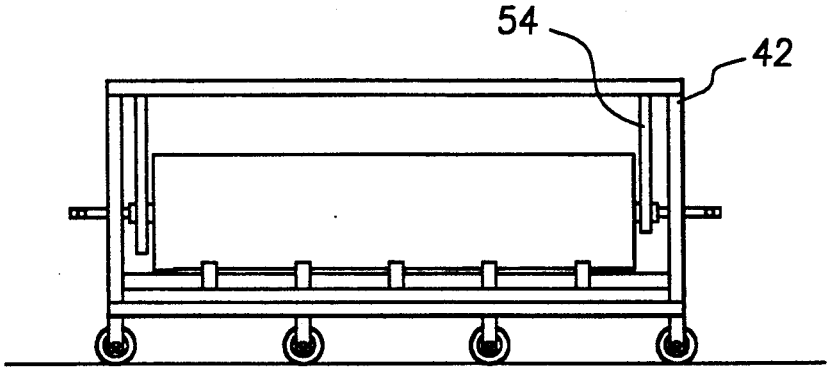
FIG. 5B is a cross-sectional view of the alternate embodiment of the lining dispenser of the present invention taken along line 5B—5B of FIG. 5A.
Figure 5C:
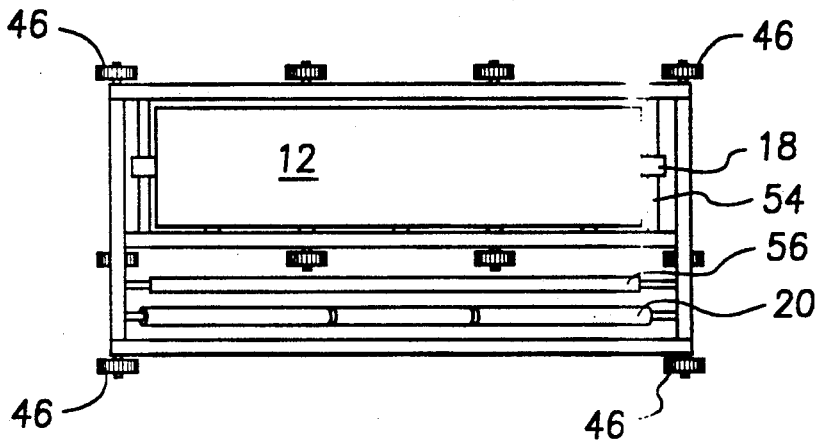
FIG. 5C is a cross-sectional view of the alternate embodiment of the lining dispenser of the present invention taken along line 5C—5C of FIG. 5A.
Figure 5D:
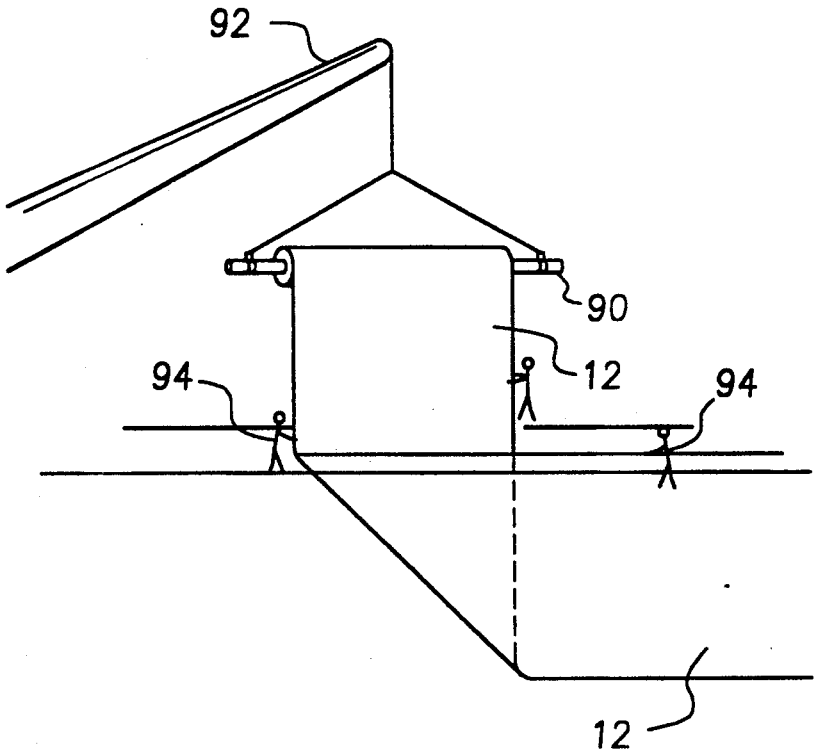
FIG. 5D is a perspective view of another embodiment for the lining dispenser.

As shown in FIG. 4C, the support line 16 and associated wheel 62 and spool 66 may be replaced with a dispensing bar 80. In the preferred embodiment, the dispensing bar 80 has a length about the same as the dispenser 40. The fasteners 26 along the top edge of the liner 12 may be attached to the dispensing bar 80 to hold the liner 12 in the correct horizontal orientation. Once the dispenser 40 is moved further along the trench 22, the fasteners 26 will reach the end of the dispensing bar 80. Once a particular fastener 26 passes the end of the dispensing bar 80, the position of the liner 12 can be maintained by supporting the liner 12 by attaching the fastener 26 to a support bar 38. An alternate embodiment for the dispenser 40 is also shown in FIGS. 5A–5C. In particular, in FIG. 5A, the use of the dispensing bar 80 and its attachment to the dispenser is shown. In FIG. 5D, Yet another embodiment for the dispenser 40 is shown. In this embodiment, roll of liner 12 is mounted on a rod 90 that is suspended above the ground by attachment to a crane 92 in a conventional manner as known to those skilled in the art. The top edge of the liner 12 is held taut by the application of force in opposite directions by workers 94 holding the liner 12 at opposite ends of the trench 22. Consistent with present invention, the liner 12 is inserted into the trench 22 by unrolling the liner 12 in a vertical orientation and folding the liner to the horizontal position. The weight of the liner 12 and the taut top edge allow the liner 12 to be inserted in this manner.

Figure 9B:
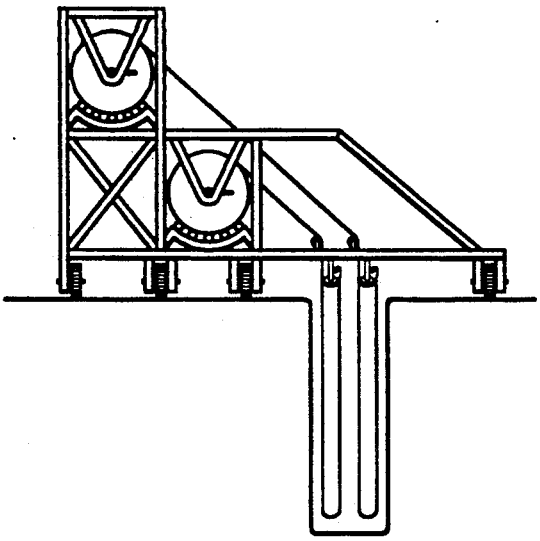
Figure 9B:
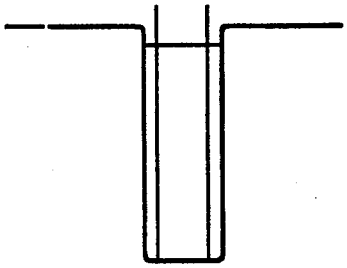
Figure 9B:
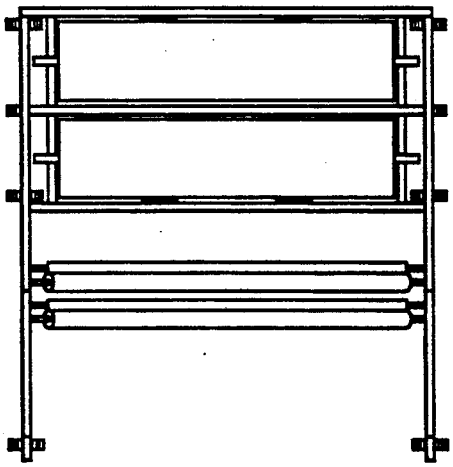

Referring now to FIGS. 9A-9D, two alternate embodiments of the Present invention are shown. In situations where even lower level of permeability are required, the system of the present invention may be used to simultaneously install a plurality of linings in a slurry wall. As shown in FIGS. 9A and 9C, each lining being inserted into the trench 22 uses its own guide 20, support line 16, and set of guide rollers 56. FIG. 9A illustrates a system for providing a double lining in the construction of a slurry wall where the rolls of the liner 12 rotate in the same direction, while FIG. 9C shows an embodiment where each roll of liner 12 rotates in an opposite direction. As can been seen from FIGS. 9A and 9C, the dispenser 40 of the present invention can be modified to install two rolls of liner 12. Typically, when dispensers as shown in FIGS. 9A and 9C are used, the linings will be positioned parallel in the trench 22 either in or to the side of the cutoff wall. However, the present invention provides for a complete lining that surrounds the cutoff wall. As shown in FIG. 9D, when double linings are used, the bottom edge of the liner 12 may be sealed and attached as the liners are inserted. Once the liners are in place, the cutoff wall can then be formed by backfilling the trench 22 by placing the excavated soil and selected materials between the two linings. Backfilling in this manner will force the liners outward against the walls of the trench 22. Once the backfilling is completed the two sealed liner will surround the cutoff wall.

Referring now to FIGS. 10A-10E, the preferred method of the present invention for installing a liner in a cutoff wall will be described in detail. FIGS. 10A-10E illustrate a cross-sectional view of the trench as the cutoff wall is being constructed. For ease of understanding and clarity, the dispenser 40 will be omitted from the figures. However, it should be understood that whenever a roll 82 of liner 12 is shown it is implied that the dispenser 40 is positioned to hold the roll 82 of liner 12 positioned as shown.

Figure 10A:
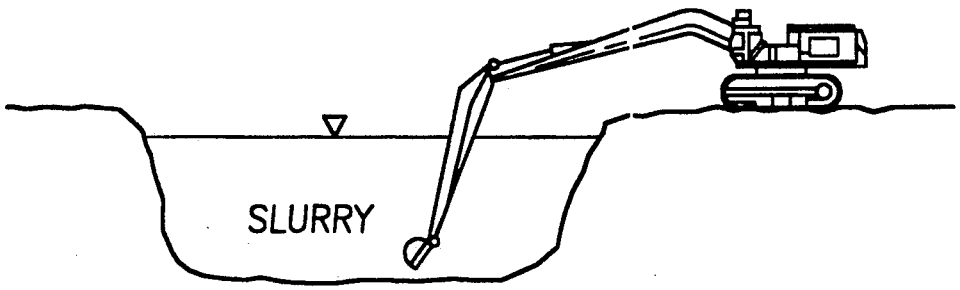
FIGS. 10A–10E illustrate cross-sectional views of the slurry wall during various steps of the method of the present invention.
Figure 10B:
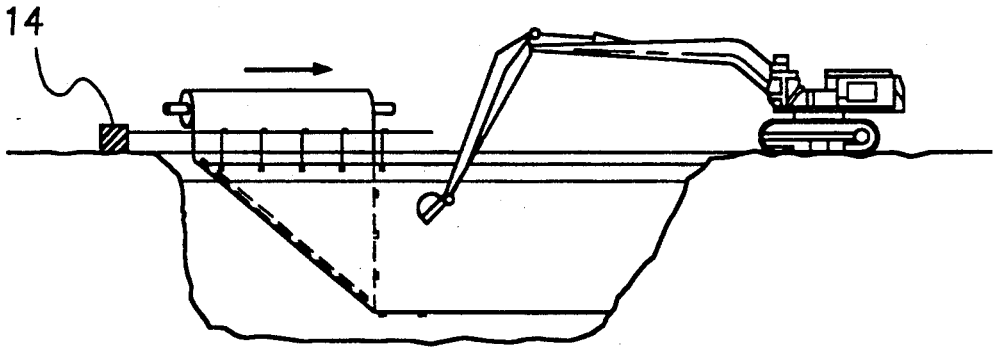
Figure 10C:
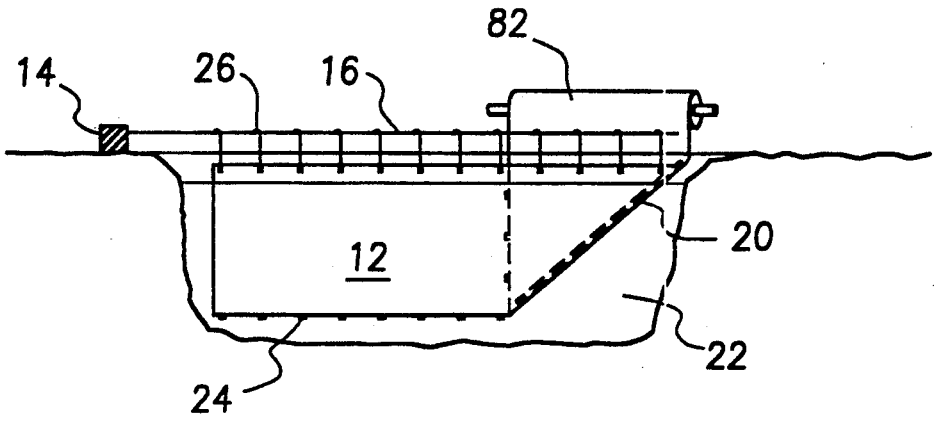
Figure 10D:
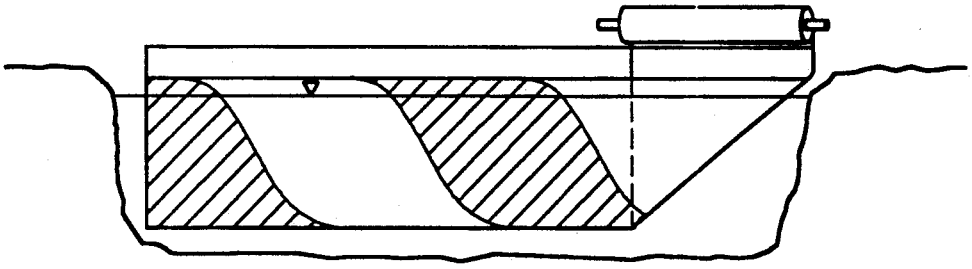

As illustrated in FIG. 10A, the first step in the method of the present invention is to excavate a trench 22 and fill the trench 22 with slurry. The slurry in the trench 22 is preferably maintained at a level close to ground level during the excavation step by pumping additional slurry into the trench 22 as required. Next, the anchor 14 is secured in the ground near the beginning of the trench 22. The dispenser 40 is then positioned over the trench 22 and the top corner of the liner 12 is threaded down into the trench 22 about the guide 20 of the dispenser 40. The appropriate corner of the liner 12 is then pulled toward the anchor 14 and attached to the anchor 14 to secure its position relative to the anchor 14. A support line 16 is also connected to the anchor 14 and positioned at a predetermined level above a portion of the trench 22, as shown in FIG. 10B. The next step in the method of the present invention is to begin insertion of the liner 12 into the trench 22. This occurs automatically as the liner dispenser 40 is moved along the trench 22 away from the anchor 14 and the liner 12 is unrolled about the guide 20 to a position in the slurry as shown in FIG. 10C. The weights 24 advantageously pull the bottom edge of the liner 12 to the bottom of the trench 22 while the opposite edged is secured near the top of the trench 22 by the supporting line 16. In the preferred embodiment, the rotation speed of the roll of liner 12 matches the distance the dispenser 40 is moved, thereby, maintaining tension on the support line 16 and also the top edge of the liner 12. After insertion, the liner 12 is checked to ensure that the bottom of the liner 12 reaches and contacts the bottom of the trench 22. Once a substantial Portion of the liner 12 has been inserted into the trench 22, it may be backfilled with selected materials such as commercially available clays, bentonite or cement as shown in FIG. 10D. Preferably the steps on excavating the trench, inserting slurry, inserting the liner, and backfilling occur simultaneously, but at different portions of the trench.

Figure 10E:
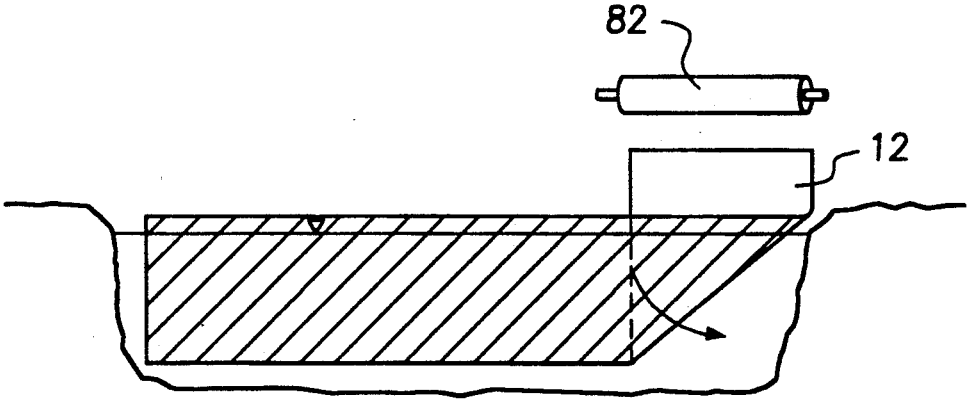

With the present invention, the trench 22 may be backfilled on both sides to position the liner 12 in the middle of the cutoff wall, or backfilled on either side to position the liner 12 as desired. One preferred method for backfilling the trench is illustrated by FIGS. 12A-12C. First, the liner 12 is positioned close to one wall of the trench as shown in FIG. 12. Second, the trench is backfilled by inserting materials between the liner 12 and the closest wall. By backfilling in this manner, the material forces the liner 12 along the bottom of the trench and along one wall as the material settles in the trench. Thus, a tight impermeable seal is formed along the side and bottom of the cutoff wall as shown in FIG. 12C. Once the end of the trench 22 is reach, the liner 12 is cut to separate the roll 82 form the portion of the liner 12 in the trench 22 as shown in FIG. 10E. The dispenser 40 may the be removed and the liner 12 is allowed to fall into position. Because of weight on the bottom edge of the liner 12, the bottom edge will swing into place if the top edge of the liner 12 is held in position above the trench 22. It should be understood that in most instances, permeability will be critical. Thus, the low permeability can be preserved by waiting to backfill the beginning of the trench 22 until an overlapping layer of liner 12 can be placed parallel to the beginning of liner. This overlapping technique is will be discussed in more detail with reference to FIG. 11, and may also be applied when it is necessary to change rolls of liner 12 or to place liner 12 in a trench that follows an orthogonal path.

Figure 11A:
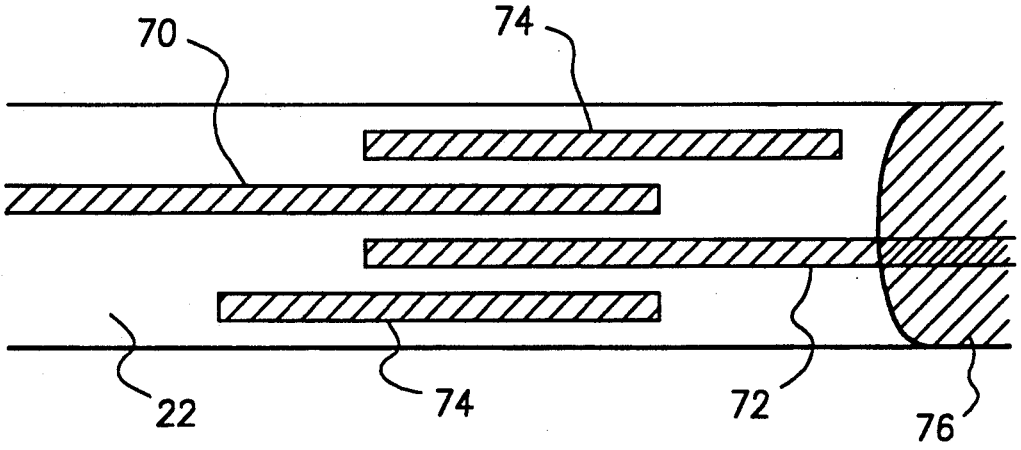
FIGS. 11A–11C illustrate top plan views of trenches and liners using the preferred method for connecting liners within a trench.
Figure 11B:
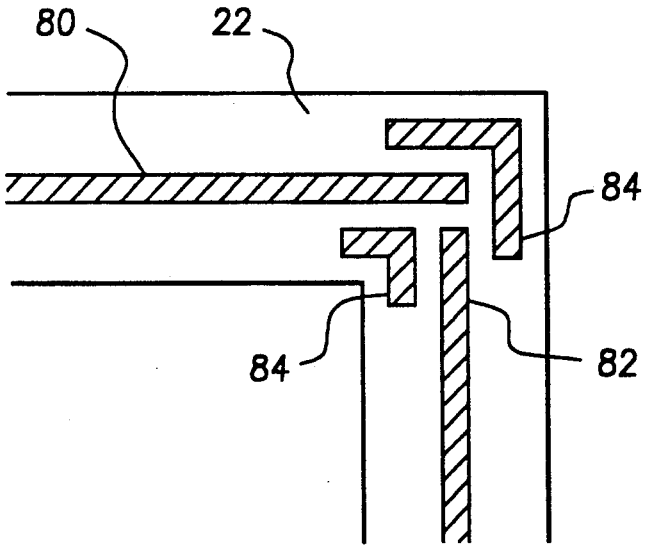
Figure 11C:
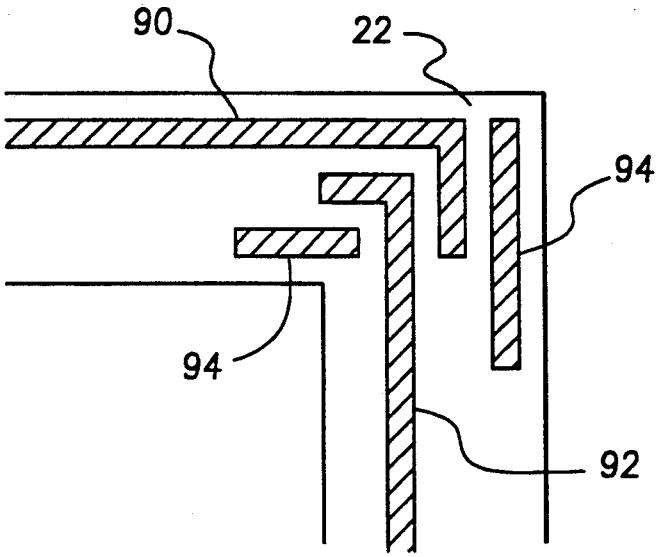
Figure 12A:
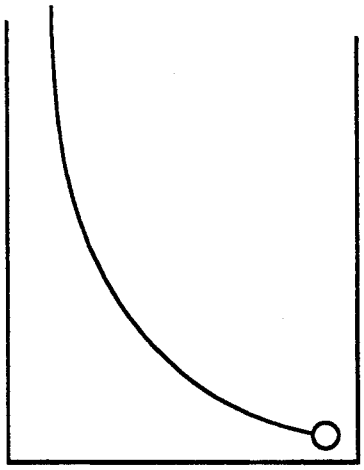
FIGS. 12A–12C illustrate cross-sectional views of a trench and liner during backfilling of the trench.
Figure 12B:
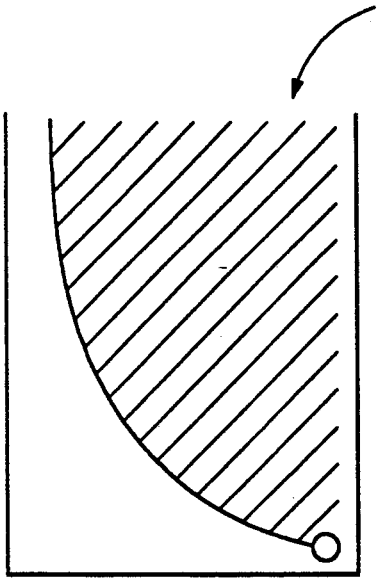
Figure 12C:
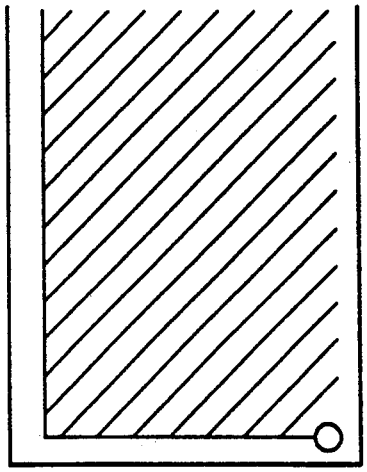

Referring now to FIG. 11, top plan views of various trenches illustrate the use of the system of the present invention in nonlinear trenches and the use of noncontinuous liners in a single trench. As shown in FIG. 11A, a liner 12 may not be long enough for the trench and two liners must be used. The present invention achieves low permeability by inserting a first liner 70 into the trench and then overlapping a portion of the first liner 70 with a second liner 72. Impermeability is further increased by inserting liner segments 74 on both side of the overlap. The trench is then backfilled on the same side of all the liners 70, 72 and 74 to force them together and from a strong barrier. A similar overlapping technique is used to apply the present invention to trenches that have nearly orthogonal segments as shown in FIG. 11B and 11C. For example, in FIG. 11B, a first liner 80 is placed in the first segment of the trench using the dispenser 40. Next a second liner 82 is placed in the second segment of the trench with the first and second liners 80, 82 in very close proximity. Next, "L" shaped liner segments 84 are inserted in the trench on both sides of the seam between the first and second liner 80, 82. Another method where the first and second liners 90, 92 have overlapping portions and the liner segments 94 are positioned on both sides of the overlap is shown in FIG. 11C. These methods of installing liners make the system and method of the present invention useable for most any type of cutoff wall.

Having described the present invention with reference to specific embodiments, the above description is intended to illustrate the operation of the preferred embodiments and is not meant to limit the scope of the invention. The scope of the invention is to be delimited only by the following claims. From the above discussion, many variations will be apparent to one skilled in the art that would yet be encompassed by the true spirit and scope of the present invention.

What is claimed is:

1. A system using a slurry trench for constructing a cutoff wall with improved impermeability, said system comprising:

a liner;

a dispenser for moving the liner along the trench and holding the liner in a rolled position parallel to the longitudinal axis of the trench;

a guide for inserting the liner in an unfolded configuration into the trench, said guide adjustably mounted to the dispenser for positioning the guide in the trench to transition the liner from a vertical orientation on the dispenser to a horizontal orientation in the trench; and an anchor for securing the liner in a fixed position, said anchor attached to the liner.

2. The system of claim 1, wherein the liner further comprises a plurality of weights attached spaced apart along a longitudinal edge of the liner.

3. The system of claim 2, further comprising:

a support line having a first end attached to the anchor for positioning the support line at a predetermined height above the trench; and wherein the liner further comprises a plurality of fasteners attached spaced apart along the longitudinal edge of the liner opposite the weights, said fasteners adapted for attachment to the support line.

4. The system of claim 3, wherein the fasteners are attached to the liner with strips of plastic for distributing the force applied by the fasteners across the liner.

5. The system of claim 1, wherein the liner further comprises impermeable plastic.

6. The system of claim 1, wherein the liner is constructed of polyvinyl chloride.

7. The system of claim 2, wherein the weights are attached to the liner with support strips for distributing the force applied by the weights across the liner.

8. The system of claim 1, wherein the dispenser further comprises a plurality of rollers that allow the liner to be unrolled, said rollers mounted on a seat of the dispenser and the rolled portion of liner is positioned on the rollers.

9. The system of claim 1, wherein the dispenser further comprises a plurality of guide rollers mounted to the dispenser for directing the liner toward the guide as it is unrolled.

10. The system of claim 1, wherein the dispenser further comprises:

a plurality of frame members;

a plurality of longitudinal supports coupling the frame members together;

a pair of extension arms attached to a central Portion of the outermost frame members to extend over the trench;

a plurality of lateral supports attached between the extension arms and the frame members; and a plurality of wheels respectively attached to the frame members and the extension arms.

11. The system of claim 1, wherein the dispenser further comprises a dispensing bar mounted to the dispenser, said dispensing bar mounted in a position above the trench to hold a top longitudinal edge of the liner, said dispensing bar sized for attachment with fasteners attached to the top longitudinal edge of the liner.

12. The system of claim 1, further comprising a plurality of dispensing bars adapted to extend across the trench to hold a top longitudinal edge of the liner at a predetermined position in the trench, said dispensing bars adapted to receive fasteners attached to the top longitudinal edge of the liner.

13. The system of claim 1, wherein the dispenser is adapted to hold and insert a plurality of liners, and the system includes a plurality of guides corresponding in number to the number of liners.

14. The system of claim 1, wherein the guide further comprises:

a shaft;

a cylindrical roller mounted to rotate about the shaft; and an adjustable mounting means attached between the dispenser and shaft for positioning the shaft between a first position parallel to the plane formed by the ground and a second position in the trench at an angle acute to the plane formed by the ground.

15. The system of claim 14, where in the guide further comprises:

a second roller mounted to the shaft; and a lever mounted to the shaft between the cylindrical roller and second roller.

16. The system of claim 1, wherein the guide further comprises a shaft extending into the trench, and a plurality of spheres mounted spaced apart along the shaft and adjacent to the liner.

17. A method for inserting a liner during the construction of a cutoff wall, said method comprising the steps of:

excavating a trench;

filling the trench with slurry and maintaining the slurry at a predetermined level as the trench is excavated;

inserting the liner using a dispenser that unrolls the liner in an unfolded configuration and in a vertical orientation into the trench and then positions the liner in a horizontal orientation as the dispenser is moved along the trench; and backfilling the trench with selected materials on noe or both sides of the liner.

18. The method of claim 17, where in the step inserting transitions the liner from the vertical orientation to the horizontal orientation by passing the liner about a guide as the dispenser is moved along the trench.

19. The method of claim 17, further comprising the step of securing an end of a liner near the beginning of the trench.

20. The method of claim 17, wherein the step of excavating, filling and inserting occur simultaneously for different portions of the trench.

21. The method of claim 17, wherein the step of inserting places the liner in a position close to a wall of the trench and wherein the trench is backfilled by placing the selected material on the side of the liner closest to the wall.

22. The method of claim 17, further comprising the steps of:

securing a support line above the trench;

attaching fasteners to a top longitudinal edge of the liner;

fastening the fasteners to the support line to retain the liner in a predetermined position in the trench; and removing the support line and fasteners after the step of backfilling.

23. The method of claim 17, wherein the step of inserting unrolls and inserts the liner at a rate about equal to the rate at which the dispenser is moved along the trench

24. A system using a slurry trench for constructing a cutoff wall with improved impermeability, said system comprising:

a liner;

a dispenser for moving the liner along the trench and holding the liner in a rolled position, the dispenser having a wheel mounted to the dispenser for engaging and guiding a support line in a position above the trench, and a spool mounted to the dispenser for removing and providing slack in the support line by winding and unwinding respectively, as the dispenser is moved with respect to the anchor;

a guide for inserting the liner into the trench, said guide adjustably mounted to the dispenser for positioning the guide in the trench to transition the liner from a vertical orientation on the dispenser to a horizontal orientation in the trench;

an anchor for securing the liner in a fixed position, said anchor attached to the liner;

the support line having a first end attached to the anchor for positioning the support line at a predetermined height above the trench, and including a plurality of fasteners attached to the support line and attached spaced apart along the longitudinal edge of the liner opposite the anchors.

* * * * *

UNITED STATES PATENT AND TRADEMARK OFFICE

CERTIFICATE OF CORRECTION

PATENT NO. : 5,246,312
DATED : September 21, 1993
INVENTOR(S) : Osamu Taki

It is certified that error appears in the above-indentified patent and that said Letters Patent is hereby corrected as shown below:

Column 1, line 8, delete "Present" and insert --present--.

Column 1, line 59, after "preferred" insert --embodiment of the lining system of the present--.

Column 1, line 62, delete "Preferably" and insert --preferably--.

Column 2, line 19, delete "Preferred" and insert --preferred--.

Column 2, line 41, delete "Preferred" and insert --preferred--.

Column 2, line 59, delete "Preferred" and insert --preferred--.

Column 7, line 2, delete "Present" and insert --present--.

Column 8, line 2, delete "Portion" and insert --portion--.

Column 10, line 47, delete "noe" and insert --one--.

Signed and Sealed this

Twenty-ninth Day of March, 1994

Bruce Lehman

*Attest:*

BRUCE LEHMAN

*Attesting Officer*

*Commissioner of Patents and Trademarks*